US005464126A

United States Patent [19]

Mondini

[11] Patent Number: 5,464,126

[45] Date of Patent: Nov. 7, 1995

[54] VOLUMETRIC DOSAGE MACHINE PARTICULARLY FOR GRANULATES, POWDERS AND LOOSE PRODUCTS IN GENERAL

[75] Inventor: Giovanni Mondini, Cologne Bresciano, Italy

[73] Assignee: G. Mondini S.p.A., Cologne Bresciano, Italy

[21] Appl. No.: 184,340

[22] Filed: Jan. 21, 1994

[30] Foreign Application Priority Data

Aug. 2, 1993 [IT] Italy ..... MI93A1760

[51] Int. Cl.[6] ..... B67D 5/64

[52] U.S. Cl. ..... 222/162; 222/197; 222/199; 222/220; 222/345; 222/359; 222/371

[58] Field of Search ..... 222/161, 162, 222/197, 199, 200, 216, 220, 345, 346, 359, 371

[56] References Cited

U.S. PATENT DOCUMENTS

| | | | |
|---|---|---|---|
| 2,529,654 | 11/1950 | Gilmore . | |
| 2,706,989 | 4/1955 | Zint | 222/346 X |
| 3,276,637 | 10/1966 | Fender | 222/345 |
| 3,330,311 | 7/1967 | Christine . | |
| 4,486,126 | 12/1984 | Hellerman | 222/345 X |
| 4,733,594 | 3/1988 | Bajohr | 222/359 X |
| 4,964,546 | 10/1990 | Morrow . | |
| 5,183,507 | 2/1993 | Scherer | 222/345 X |

FOREIGN PATENT DOCUMENTS

| | | |
|---|---|---|
| 445158 | 11/1912 | France . |
| 645093 | 4/1937 | Germany . |
| 982387 | 2/1965 | United Kingdom . |

*Primary Examiner*—Andres Kashnikow
*Assistant Examiner*—Joseph A. Kaufman
*Attorney, Agent, or Firm*—Guido Modiano; Albert Josif

[57] ABSTRACT

Volumetric dosage machine particularly for granulates, powders and loose products in general, including products that are not uniform or mutually compacted and have a very limited flow ability, comprising a hopper for loading a product to be metered that is provided with a bottom which has a plurality of dosage chambers and is movable to transfer the dosage chambers from a loading position to a discharge position spaced from the loading position, and/or vice versa. There is also a skimming unit interacting with the dosage chambers during the movement of the bottom.

5 Claims, 4 Drawing Sheets

VOLUMETRIC DOSAGE MACHINE PARTICULARLY FOR GRANULATES, POWDERS AND LOOSE PRODUCTS IN GENERAL

BACKGROUND OF THE INVENTION

The present invention relates to a volumetric dosage machine particularly for granulates, powders and loose products in general, including products that are not uniform or mutually compacted and have an extremely limited flow ability.

As is known, conventional volumetric dosage machines are based on different operating principles, a common characteristic of which is the provision of a dosage chamber arranged on the bottom of the loading hopper to be filled with the product to be metered and provided with various systems that in succession open the chamber with respect to the hopper while closing the bottom, close the chamber with respect to the hopper to separate the chamber from the overlying product, and subsequently open to discharge the metered product.

In order to perform this sequence of opening and closing operations, usually there are gates or impeller-like elements, a common characteristic of which is that they often damage the product, since when the dosage chamber is closed with respect to the hopper, a shearing action is unavoidably applied to the product and can, in many cases, damage it.

Furthermore, another drawback of the solutions of the known art is that in all known systems one dosage chamber at a time is filled and emptied, consequently slowing the production cycle.

SUMMARY OF THE INVENTION

The aim of the present invention is to eliminate the drawbacks described above by providing a volumetric dosage machine particularly for granulates, powders and loose products in general, including products that are not uniform or mutually compacted and have a very limited flow ability, which allows dosage without having to close the dosage chamber, by means of gates or the like, with respect to the hopper that contains the product being metered, thus preventing any damage to the product.

Another object of the present invention is to provide a volumetric dosage machine which allows to perform, during each individual operating cycle, simultaneous dosage in multiple mutually adjacent chambers, so as to simultaneously fill multiple containers.

Another object of the present invention is to provide a volumetric dosage machine particularly for granulates, powders and loose products in general, including products that are not uniform or mutually compacted and have a very limited flow ability, which by virtue of its particular constructive characteristics gives the greatest assurances of reliability and safety in use.

Another object of the present invention is to provide a volumetric dosage machine particularly for granulates, powders and loose products in general, including products that are not uniform or mutually compacted and have a very limited flow ability, which can be easily obtained with commonly commercially available elements and materials and is furthermore competitive from a merely economical point of view.

With these and other objects in view, there is provided, according to the present invention, a volumetric dosage machine particularly for granulates, powders and loose products in general, including products that are not uniform or mutually compacted and have a very limited flow ability, characterized in that it comprises a hopper for loading a product to be metered, said hopper being provided with a bottom which has a plurality of dosage chambers and is movable to transfer said dosage chambers from a loading position to a discharge position spaced from said loading position, and/or vice versa, a skimming unit being furthermore provided that interacts with said dosage chambers during the movement of said bottom.

BRIEF DESCRIPTION OF THE DRAWINGS

Further characteristics and advantages of the present invention will become apparent from the following description of a preferred but not exclusive embodiment of a machine according to the invention, illustrated only by way of non-limitative example in the accompanying drawings, wherein.

DESCRIPTION OF THE PREFERRED EMBODIMENTS

Figure 1:
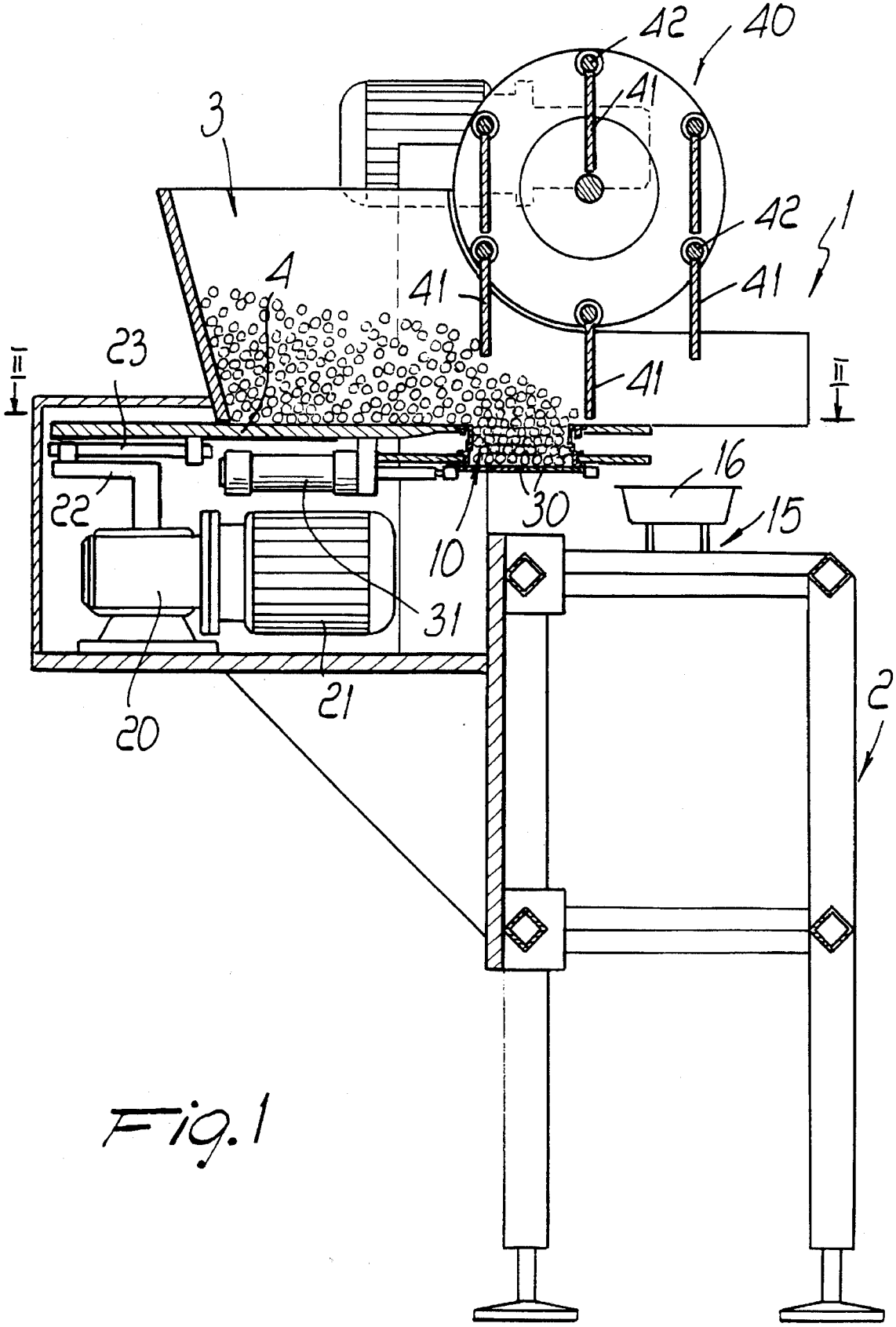
FIG. 1 is a schematic sectional view of the volumetric dosage machine according to the present invention, with the bottom in loading position.
Figure 2:
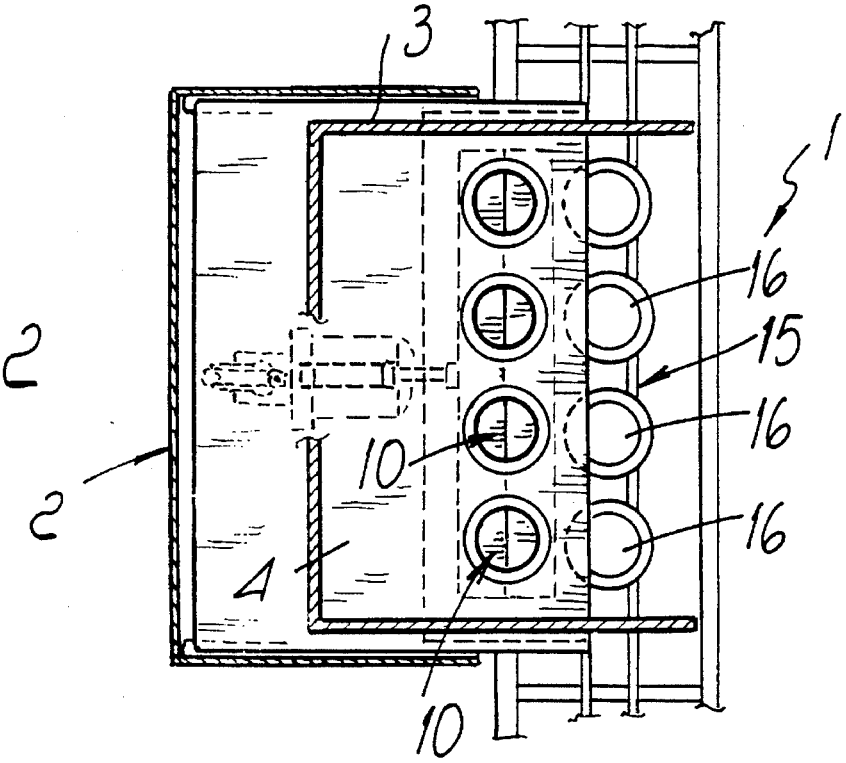
FIG. 2 is a sectional view, taken along the plane II—II of FIG. 1.

With reference to the above figures, the volumetric dosage machine particularly for granulates, powders and loose products in general, including products that are not uniform or mutually compacted and have a very limited flow ability, according to the present invention, generally designated by the reference numeral 1, comprises a supporting frame 2 to which a hopper 3 for loading a granulated product, a powder or in any case loose products in general is connected.

The hopper 3 is closed downward by a bottom 4 having a plurality of dosage chambers, designated by the reference numeral 10, which are advantageously mutually aligned.

The bottom 4 of the hopper 3 is movable so as to transfer the dosage chambers 10 from a loading position to a discharge position spaced from said loading position, so that during discharge the product fed by the hopper does not bear on the dosage chambers.

The discharge is provided at a conveyor, generally designated by the reference numeral 15, that has a plurality of containers 16 for collecting the metered product.

The bottom 4 can move substantially at right angles with respect to the alignment direction of the various dosage chambers 10; four chambers are provided in the example shown in the drawings, but can obviously be present in any number.

Figure 3:
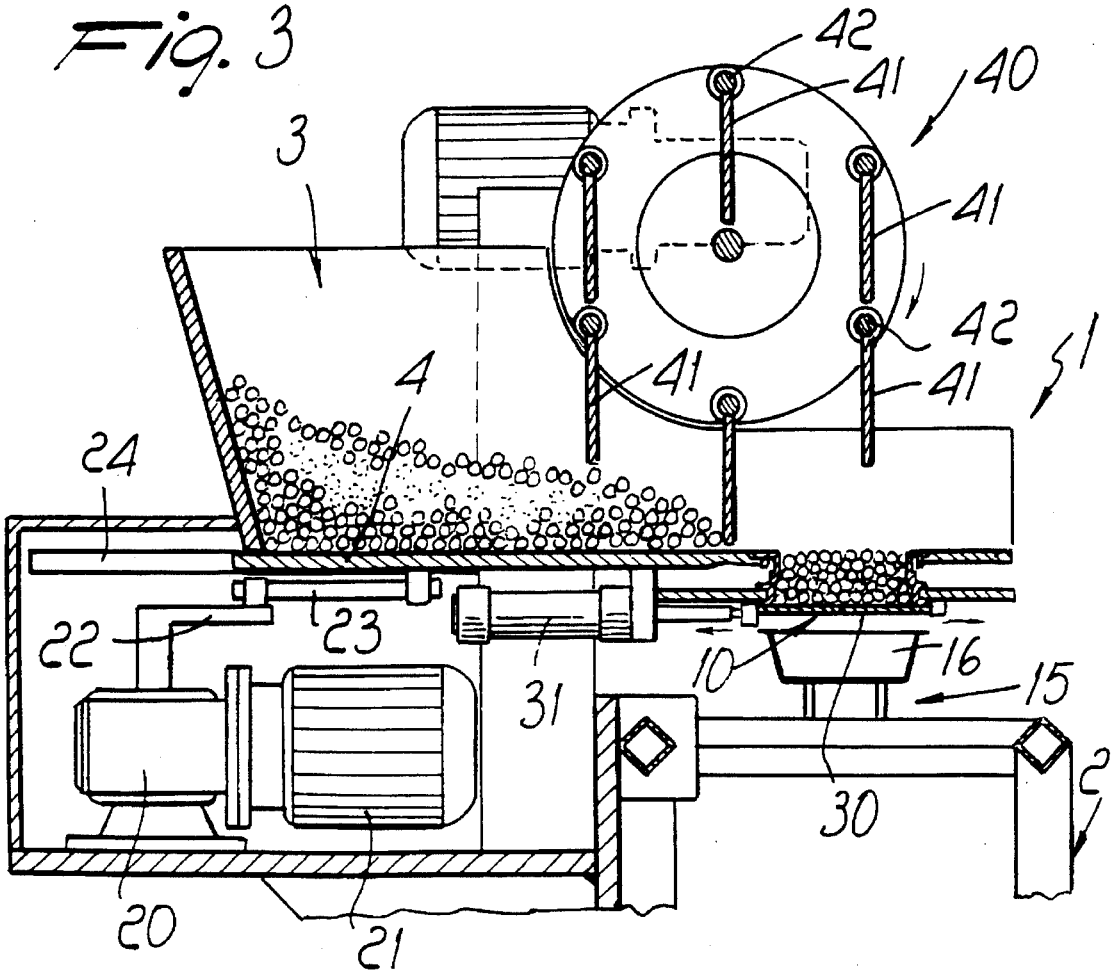
FIG. 3 is a view of the volumetric dosage machine with its bottom moved into the discharge position.

In order to move the bottom 10 there are means for reciprocating motion which are constituted, for example, by a gearmotor unit 20, mounted on the supporting frame 2 and driven by a motor 21, which connected thereto. As clearly shown in FIG. 1, the motor 21 rotates an eccentric element 22 articulated to a link 23 that is in turn pivoted to the lower face of the bottom. Thus, when the gearmotor unit 20 is driven by the motor 21, the bottom 4 is moved back and forth in a reciprocating manner along the direction of the guides 24 which support said bottom (see FIG. 3), i.e., in a perpendicular direction with respect to the alignment direction of the dosage chambers 10. Thus, upon activating the motor 21 to drive the gearmotor 20, rotational movement is converted by the eccentric element into reciprocating movement of the bottom, back and forth along the guides in a direction perpendicular to the alignment direction of the dosage chambers.

The dosage chambers 10 are rigidly coupled to the bottom and are closed in a downward region by gates 30 actuated by actuation means which can be constituted for example by a piston 31 which, when operated, opens the gate to discharge the product contained in the chamber 10.

The volumetric dosage machine furthermore comprises a skimming unit, generally designated by the reference numeral 40, which acts above the bottom of the hopper and interacts with the dosage chambers 10 during their movement so as to remove the product in excess, i.e. the product that juts out of the dosage chamber.

The skimming unit 40 is advantageously constituted by a cylindrical frame which has a plurality of paddles 41 uniformly distributed along the circumference and pivoted to bars 42 that are arranged parallel to the axis of the cylindrical frame and are uniformly distributed along the circumference.

When the cylindrical frame rotates, the paddles slide above the dosage chamber, which is in motion in order to pass from the loading region to the discharge region, thus gently removing the product in excess.

The use of oscillating paddles eliminates the occurrence of shearing actions on the product which could, in many cases, damage it.

In practical operation, as shown in FIG. 1, the dosage chambers 10 initially arrange themselves in the loading region, on the left with reference to the drawing, where the product enters the dosage chambers, which are open upward and are closed downward by the gate 30.

After this step, the bottom is moved toward the discharge region (FIG. 3), and during this step the paddles 41 of the skimming unit 40 in practice remove the product in excess that juts out of the dosage chambers 10, pushing it back toward the loading part of the hopper 3.

Figure 4:
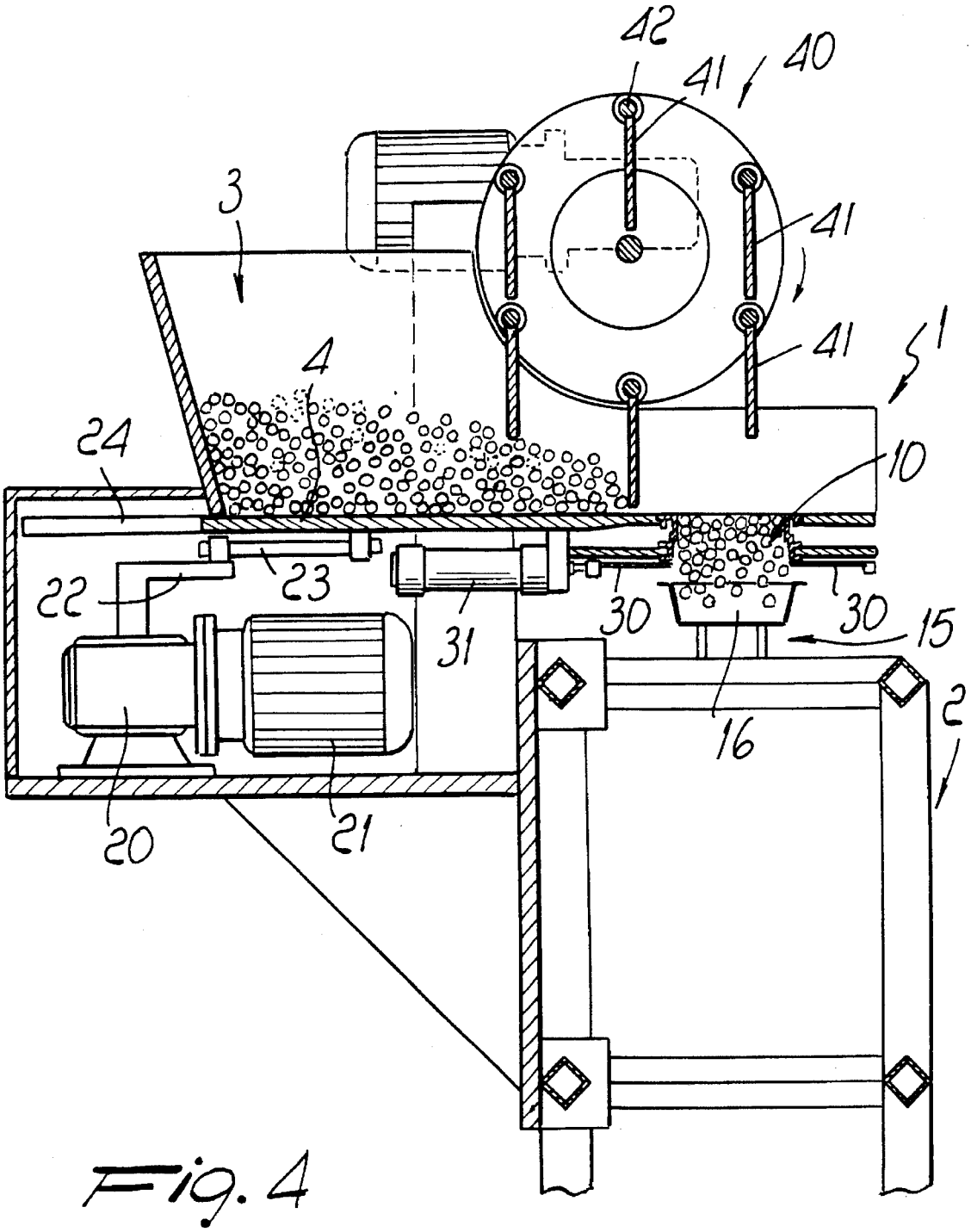
FIG. 4 is a view of the volumetric dosage machine during the discharge of the metered product.

Once the dosage chambers 10 are located in the discharge station, above the various containers 16 (FIG. 4), the gates 30 are opened and the product falls into the underlying containers.

Figure 5:
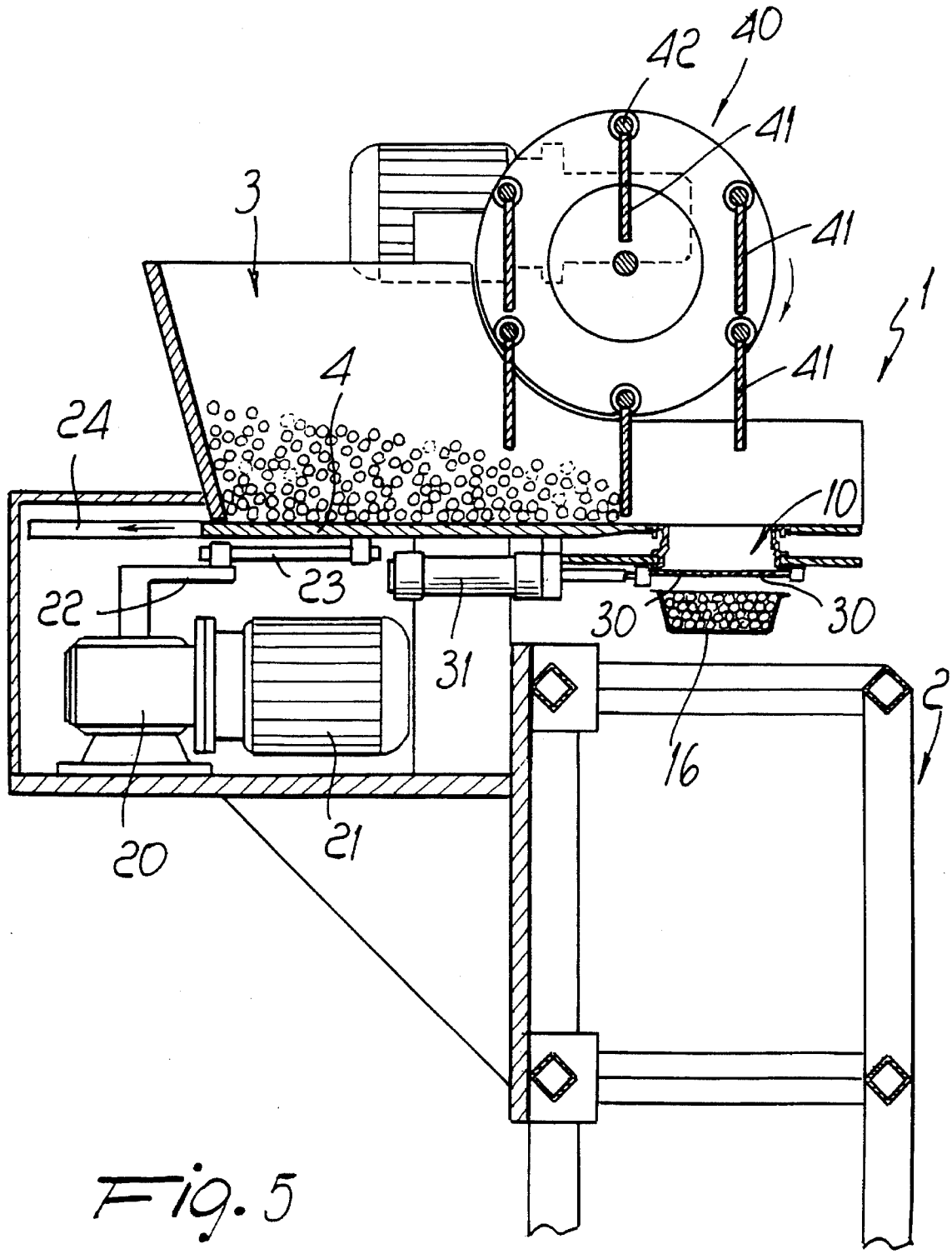
FIG. 5 is a view of the volumetric dosage machine after discharging the metered product into a container.

Afterwards, (FIG. 5) the gates are closed again and the bottom is returned to the initial condition shown in FIG. 1, in which the product is loaded and the cycle is repeated in a similar manner.

To the above it should be added that the movement of the bottom 4 is uniform and continuous, so that there is a continuous cycle for the passage of the dosage chambers from the loading region to the discharge region.

It should be noted that during the opening of the dosage chambers 10, said chambers need not to be closed upward by gates which separate them from the hopper 3, since the chambers are moved to a region where the product fed by the hopper is not present, as the skimming device 40, by rotating, always keeps the product in the loading region in addition to skimming the various chambers.

Another important aspect is that the apparatus described above allows to simultaneously fill a plurality of dosage chambers and to simultaneously discharge them in order to fill the various containers located on a conveyor which advantageously advances in steps.

The invention thus conceived is susceptible to numerous modifications and variations, all of which are within the scope of the inventive concept.

All the details may furthermore be replaced with other technically equivalent elements.

In practice, the materials employed, as well as the contingent shapes and dimensions, may be any according to the requirements.

I claim:

1. Volumetric dosage machine particularly for granulates, powders and loose products in general, including products that are not uniform or mutually compacted and have a very limited flow ability, comprising:

a supporting frame;

a hopper for loading product to be metered connected to said supporting frame;

a bottom downwardly closing said hopper;

a plurality of dosage chambers defined by said bottom, said dosage chambers being aligned in an alignment direction;

means for moving said bottom between a dosage chamber loading position and a dosage chamber discharge position, and;

a skimming unit located adjacent said hopper for removing excess products from said dosage chambers, and;

means for reciprocating movement of said bottom comprising:

guides extending perpendicular to said alignment direction and slideably supporting said bottom;

motor means connected to said supporting frame;

a link member pivotally connected to said bottom, and;

an eccentric element pivotally connected to said link member and rotatively driven by said motor means.

2. Volumetric dosage machine according to claim 1, wherein said skimming unit comprises:

a skimming frame rotatably connected to said supporting frame, said skimming frame having a circumference and a rotation axis;

a plurality of skimming paddles distributed uniformly along said circumference of said skimming frame, and;

bars connected to said skimming paddles and extending substantially parallel to said rotation axis.

3. Volumetric dosage machine particularly for granulates, powders and loose products comprising;

a supporting frame;

a hopper for loading product to be metered connected to said supporting frame;

a bottom downwardly closing said hopper;

a plurality of dosage chambers defined by said bottom, said dosage chambers being aligned in an alignment direction;

reciprocating means for moving said bottom back and forth in a direction substantially perpendicular to said alignment direction between a dosage chamber loading position and a dosage chamber discharge position and;

rotary means for removing excess products from said dosage chambers.

4. Volumetric dosage machine according to claim 3, wherein said reciprocating means for moving said bottom back and forth in a direction substantially perpendicular to said alignment direction comprises:

guides extending perpendicular to said alignment direction and slideably supporting said bottom;

motor means connected to said supporting frame;

a link member pivotally connected to said bottom, and;

an eccentric element pivotally connected to said link member and rotatively driven by said motor means.

5. Volumetric dosage machine according to claim 4, wherein said rotary means for removing excess products from said dosage chambers comprise a skimming unit, said skimming unit comprising:

a skimming frame rotatably connected to said supporting frame, said skimming frame having a circumference and a rotation axis;

a plurality of skimming paddles distributed uniformly along said circumference of said skimming frame, and;

bars connected to said skimming paddles and extending substantially parallel to said rotation axis.

* * * * *